US005839300A

United States Patent [19]

Yoon et al.

[11] Patent Number: 5,839,300

[45] Date of Patent: Nov. 24, 1998

[54] PULSATOR FOR A WASHING MACHINE

[75] Inventors: Chong-Man Yoon; Ki-Hyun Lim, both of Seoul; Jong-Chil Lee, Incheon, all of Rep. of Korea

[73] Assignee: Daewoo Electronics Co., Ltd., Seoul, Rep. of Korea

[21] Appl. No.: 848,255

[22] Filed: Apr. 29, 1997

[30] Foreign Application Priority Data

Apr. 29, 1996 [KR] Rep. of Korea ..... 1996 9773

[51] Int. Cl.[6] ..... D06F 17/10

[52] U.S. Cl. ..... 68/134

[58] Field of Search ..... 68/133, 134, 23.6, 68/23.7; 366/276, 278, 279, 243, 314

[56] References Cited

U.S. PATENT DOCUMENTS

| | | | |
|---|---|---|---|
| Re. 18,280 | 12/1931 | Kirby | 68/133 |
| Re. 19,514 | 4/1935 | Dehle | 68/134 |
| 1,459,483 | 6/1923 | Unruh | 68/134 |
| 3,233,436 | 2/1966 | Gibson | 68/133 |
| 3,257,830 | 6/1966 | Shelton | 68/133 |
| 4,594,863 | 6/1986 | Oida | 68/133 |
| 5,473,916 | 12/1995 | Ye | 68/134 |
| 5,675,996 | 10/1997 | Cho | 68/134 |
| 5,680,780 | 10/1997 | Kim et al. | 68/134 |

FOREIGN PATENT DOCUMENTS

| | | | |
|---|---|---|---|
| 59-135095 | 8/1984 | Japan | 68/134 |
| 62-2005398 | 1/1987 | Japan | 68/134 |
| 624274 | 6/1949 | United Kingdom . | |
| 833665 | 4/1960 | United Kingdom . | |

*Primary Examiner*—Amy B. Vanatta
*Attorney, Agent, or Firm*—Jacobson, Price, Holman & Stern, PLLC

[57] ABSTRACT

A pulsator for a washing machine generates a vortex-type water current in a washing tub in order to wash washing articles. In the pulsator of a washing machine, a base plate is fixed to a shaft of the washing machine to be rotated according to a rotation of the shaft. A plurality of stirring blades are downwardly slanted from the center of the base plate to an outer periphery thereof in a sector form on a bottom surface of the base plate. The plurality of stirring blades define at least one concave collecting basing between adjacent stirring blades on the bottom surface of the base plate. The pulsator for a washing machine generates a vortex-type water current in a washing tub and evenly transmits a friction force generated by a washing water current to the washing articles in a state that a current of the washing water is not uniform inside the washing tub thereby minimizing the twist of washing articles and increasing washing efficiency.

19 Claims, 4 Drawing Sheets

PULSATOR FOR A WASHING MACHINE

BACKGROUND OF THE INVENTION

1. Field of the Invention

The present invention relates to a washing machine, more particularly to a pulsator for a washing machine capable of generating a vortex-type water current in a washing tub designed to wash articles.

2. Prior Arts

In general, a washing machine for home use is a device which can easily remove dirt and other foreign materials contained in washing articles, using washing water, detergents and so on. Such a washing machine for home use can be classified by washing method as a water whirlpool-style washing machine, a water stirring-style washing machine, or a drum-style washing machine. The water whirlpool-style washing machine is a washing machine which washes articles by friction among the articles. That is, if a pulsator mounted on the bottom of the washing tub is rotated, a heart-shaped waterflow is generated to cause contact of the washing articles with each other, so that the washing articles are washed. Pulsator is alternatively rotated in clockwise and counter-clockwise directions by driving a motor and generates a waterflow of washing water thereby generating friction force to wash the articles clean.

FIG. 1 shows a conventional pulsator 10 of a washing machine. As shown in FIG. 1, pulsator 10 has a base plate 100 and a plurality of stirring blades 102 radially formed on the upper surface of base plate 100. An upper surface of base plate 100 is inclined from a center to an outer side at a predetermined angle.

In such a conventional washing machine, base plate 100 of pulsator 10 is rotated by the rotation of a motor. Accordingly, the plurality of stirring blades 102 formed on base plate 100 are rotated. The rotation of the plurality of stirring blades 102 rotates the washing water and the washing articles. That is, the rotation of pulsator 10 generates a centrifugal force of the washing water, and the centrifugal force moves the outer periphery portion of the washing water upwards while moving the inner portion of the washing water downwards. A heart-type waterflow is formed in the washing water. Such a heart-type waterflow which is a concentric waterflow, causes the washing articles to be gathered in the center thereof and to make contact with each other so as to remove the dirt in the washing articles.

However, in the conventional pulsator for a washing machine, since an upper surface of base plate 100 is inclined down to its center, the washing water is dispersed from the center to an outer side by centrifugal force. At this time, because a center of the upper surface of base plate 100 is lower than an outer side thereof, the dispersed washing water by means of the centrifugal force is driven into the center of the upper surface of base plate 100. Accordingly, the washing articles in the washing water are driven into the center of the upper surface of base plate 100 together with the washing water so that the friction force generated by the washing water current is not evenly transmitted to the washing articles, thereby to deteriorating washing efficiency. Furthermore, since the plurality of stirring blades 102 is radially formed from an upper surface of base plate 100, the friction water current of the washing water which is generated by stirring blades 102 in the outer side of base plate 100 is stronger than that in the center thereof. Therefore, when the washing articles are driven into the center of base plate 100, the washing articles are severely twisted by the overflow of the washing water thereby damaging the articles easily.

U.S. Pat. No. 5,473,916, (issued to Byeong-Seol Ye on Dec. 12, 1995) discloses one example of a pulsator for a washing machine. A patent of Byeong-seol Ye relates a pulsator for a washing machine which improves the structure to enhance washability and to prevent material items from being tangled. In the patent of Byeong-Seol Ye, a pulsator for a washing machine includes a base, an agitating post extending eccentrically upwardly from the base, and agitating blades upstanding from the base. An upper surface of the agitating post is inclined with respect to horizontally, in circumferentially spaced relationship around the entire base. Alternatively, the blades could extend parallel to one another on only one half of the base, the other half including an upward protrusion extending circumferentially at a location adjacent an outer periphery of the other half. The patent of Byeong-Seol Ye can enhance washability and prevent material items from being tangled, but has a construction different from that of the present invention.

SUMMARY OF THE INVENTION

Accordingly, it is an object of the present invention to provide a pulsator for a washing machine capable of evenly transmitting friction force generated by a washing water current to a washing articles and minimizing twist of washing articles by washing water current to the washing articles.

In order to achieve the object, the present invention provides a pulsator for a washing machine, the pulsator comprising: a base plate fixed to a shaft of the washing machine to be rotated according to a rotation of the shaft; and a plurality of stirring blades downwardly slanted from the center of said base plate to an outer periphery thereof in a sector form on a bottom surface of the base plate and for defining at least one concave collecting basin between adjacent stirring blades.

Preferably, the pulsator has a bell shape. More preferably, the pulsator further comprises a plurality of subsidiary stirring blades radially formed between the plurality of stirring blades, the plurality of subsidiary stirring blades having a size different from that of the plurality of stirring blades.

Also, the present invention provides a pulsator for a washing machine, the pulsator comprising: a base plate fixed to a shaft of the washing machine to be rotated according to a rotation of the shaft; at least one first stirring blade downwardly slanted from the center of the base plate to the outer periphery thereof in a sector form on a bottom surface of the base plate and for defining at least one first concave collecting basin between first adjacent stirring blades on the bottom surface of the base plate; and at least one second stirring blade formed apart from the at least one first stirring blade by a predetermined distance and for defining at least one second concave collecting basin between second adjacent stirring blades and between the at least one first stirring blade on the bottom surface of the base plate, the at least one second stirring blade having a size different from that of the at least one first stirring blade and the same shape as that thereof, a center of the at least one first stirring blade and the at least one second stirring blade is disposed at an eccentric position apart from the base plate by a predetermined distance.

Preferably, a size of the at least one first stirring blade is larger than that of the at least one second stirring blade. More preferably, the pulsator further comprises at least one subsidiary stirring blade having a shape and a size different from the first and second stirring blades between the at least one first stirring blade, between the at least one second stirring blade, and between one of the at least one first stirring blade and between one of the at least one second stirring blade.

The pulsator for a washing machine according to the present invention generates a vortex-type water current in a washing tub and evenly transmits a friction force generated by a washing water current to the washing articles in a state that a current of the washing water is not uniform inside the washing tub thereby to minimizing twist of washing articles and increasing washing efficiency.

BRIEF DESCRIPTION OF THE DRAWINGS

The above object, and other features and advantages of the present invention will be apparent by describing the preferred embodiment of the present invention hereinafter with reference to the accompanying drawings in which.

DESCRIPTION OF THE PREFERRED EMBODIMENT

The preferred embodiment of the present invention will be described below in detail with reference to the accompanying drawings.

Figure 1:
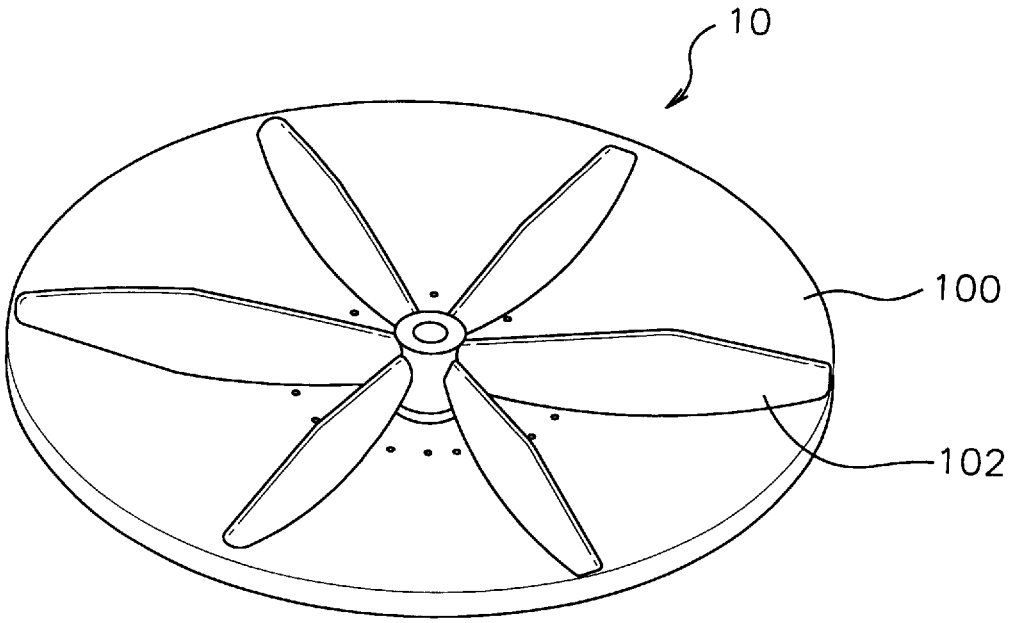
FIG. 1 is a perspective view for showing a conventional pulsator of a washing machine.
Figure 2:
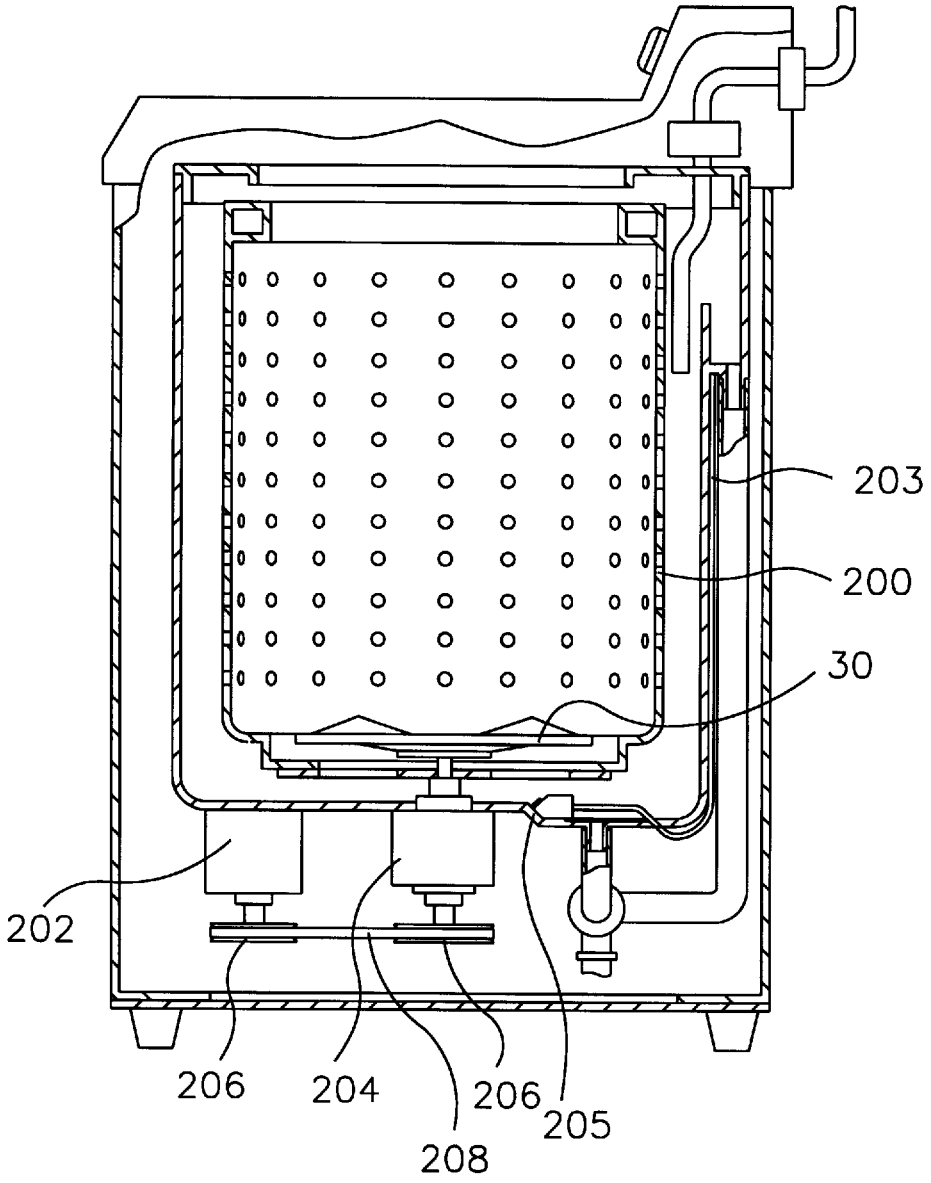
FIG. 2 is a sectional view for schematically showing a washing machine used in the present invention.

FIG. 2 shows a washing machine used in the present invention. A motor 202, which generates a rotating force with an input of external electric power, is mounted on the outer bottom of the reservoir 203. A shaft housing 204 for transmitting the rotating force of motor 202 is connected to motor 202 through pulleys 206 and a pulley belt 208. A rotating force of shaft housing 204 is transmitted to a pulsator 30 through a shaft 205. Shaft 205 protrudes inside a washing tub 200 through the bottom of reservoir 202. Pulsator 30 is fixed on the upper portion of shaft 204.

Figure 3:
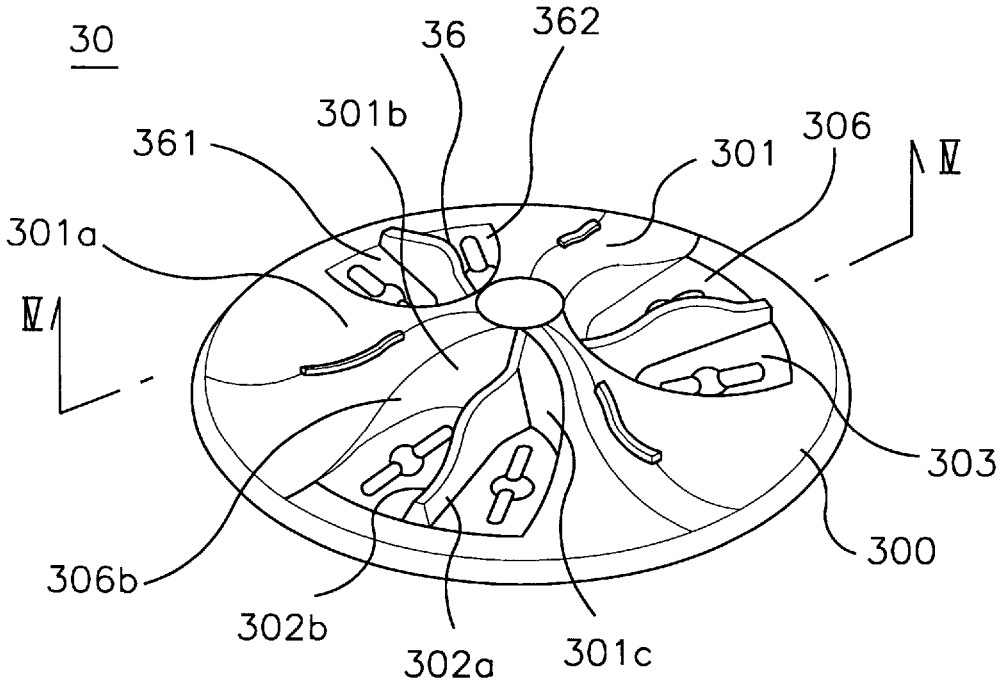
FIG. 3 is a perspective view for showing a configuration of a pulsator for a washing machine according to a first embodiment of the present invention.
Figure 4:
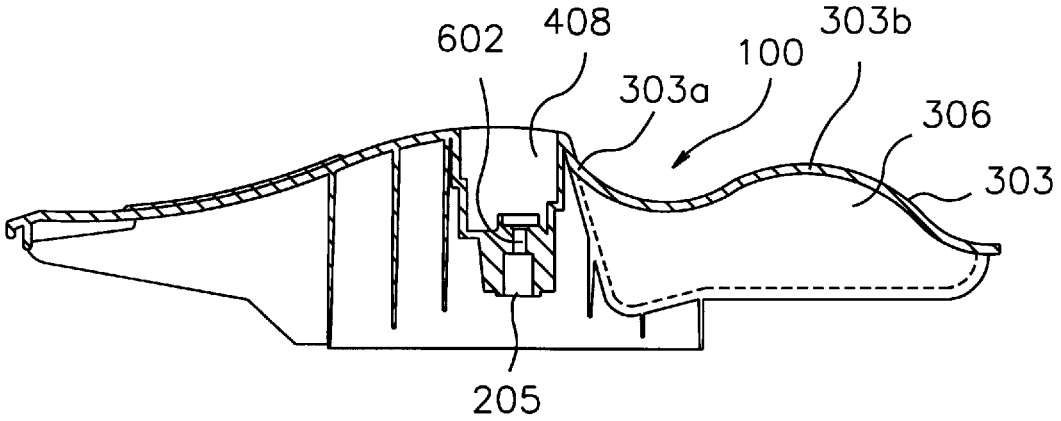
FIG. 4 is a sectional view of the pulsator taken along lines A—A of FIG. 3.

The pulsator 30 for a washing machine according to the first embodiment of the present invention will be described below. FIGS. 3 and 4 show a pulsator for a washing machine according to a first embodiment of the present invention. As shown in FIG. 3, a pulsator 30 for a washing machine, according to the first embodiment of the present invention, includes a base plate 300 and a plurality of stirring blades 302. Here, there are three stirring blades 301 as shown. The pulsator 30 for a washing machine schematically has a bell shape in a perspective view.

Referring to FIGS. 2 and 4, a shaft connecting portion 408 is formed on the center of base plate 300. Locking groove 402 is formed along the center axis of base plate 300. Base plate 300 is fixed to the shaft 205 of a shaft housing 204 through locking groove 402 and mounted in a washing tub 200. Base plate 300 includes at least one bottom surface 303 constituted by first and second bottom surfaces 303*a* and 303*b* and is rotated according to a rotation of the shaft 205 to outwardly disperse washing water by a centrifugal force. Base plate 300 is a thin plate having a disc shape.

The three stirring blades 301 are integrally and downwardly slanted from the center of base plate 300 to the outer periphery thereof in a sector form on an upper surface of base plate 300 and define three concave collecting basins 306 between adjacent stirring blades on a bottom surface 303 of base plate 300. Preferably, in the first embodiment of the present invention, three stirring blades 301 having the same shape and size to one another are provided on the upper surface of base plate 300, each being circumferentially 120° apart with respect to the adjacent stirring blades. Each of three stirring blades 301 includes a curved portion 301*a*, a first side wall 301*b*, and a second side wall 301*c*. The curved portion 301*a* is downwardly slanted from the center of base plate 300 to the outer periphery thereof in a sector form. Space between the first side wall 301*b* and the second side wall 301*c* on the bottom portion 303 of base plate 300 forms a concave collecting basin 36. The concave collecting basin 36 has the bottom surface 303 of the base plate 300 and the first and second side walls 301*b* and 301*c* of the stirring blades 301. The bottom surface 303, as viewed from the top, has a substantially elliptical cross section partially cut-away along with a line parallel to one of the axes of the ellipse. The three stirring blades 301 are rotated according to the rotation of base plate 300. The rotation of the three stirring blades 301 forms a waterflow in washing water in washing tub 200. The washing water and the washing articles are outwardly and uniformly dispersed along curved portion 301*a* of the three stirring blades 301.

The pulsator 30 for a washing machine according to the first embodiment of the present invention includes a plurality of subsidiary stirring blades 302. Here, there are shown three subsidiary stirring blades 302 radially formed between the three stirring blades 301. The size of each of the three subsidiary stirring blades 302 is different from that of each of the three stirring blades 301. Preferably, in the first embodiment of the present invention, the size of each of the stirring blades 301 is larger than that of each of the subsidiary stirring blades 302. More preferably, in the first embodiment of the present invention, three subsidiary stirring blades 301 having the same shape and size to one another are arranged among the three stirring blades 301, each being circumferentially 120° apart with respect to the adjacent subsidiary stirring blades. Each of three subsidiary stirring blades 302 protrudes upwardly from a bottom portion of base plate 300 on the center portion of a plurality of first and second basins 361 and 362, and includes first and second side walls 302*a* and 302*b* having a predetermined angle relative to the base plate 300. The first and second concave collecting basins 361 and 362 constitutes the concave collecting basin 36. An upper portion 303 of each of the subsidiary stirring blades 302 has a first concave portion 303*a*, a convex portion 303*b*, and a second concave 303*c*. Namely, the upper edge 303 of subsidiary stirring blades 302 protrudes at a radially middle portion thereof, and is downwardly sloped to either side of the middle portion.

The first space between the first side wall 301*b* of the stirring blade 301 and the second side walls 302*b* of the subsidiary stirring blade 303 on the first bottom surface 303*a* of base plate 300 forms a first concave collecting basin 361. The first concave collecting basin 361 has the first bottom surface 303*a* of the base plate 300 and the first side wall 301*b* of stirring blades 301*b*, and the second side walls 302*b* of subsidiary stirring blades 302. Second space between the second side wall 301*c* of the stirring blade 301 and the first side walls 302*a* of the subsidiary stirring blade 303 on the second bottom surface 303*b* of base plate 300 forms a second concave collecting basin 362. The second concave collecting basin 362 has the second bottom surface 303*b* of the base plate 300 and the second side wall 301*c* of stirring blades 301*b*, and the first side walls 302*a* of subsidiary stirring blades 302.

Operations of the pulsator for a washing machine according to the first embodiment of the present invention will be described below. For washing of washing articles, washing water fills washing tub 200. Upon operating the clutch (not shown), driving force of motor 202 is transmitted to pulsator 30, thereby causing pulsator 30 to be rotated forwardly and reversely. The rotation of pulsator 30 forms a predetermined waterflow in the washing water. At this time, the first washing water located on three stirring blades 301 is dispersed outward toward its lower portion along curved portion 301*a* slanted from the center of base plate 300 to the outer periphery thereof. The second washing water located on the first and second concave collecting basins 361 and 362 generates a water current having a double deflection which scatters outward toward an upper portion of base plate 300.

As the washing articles flow around by a first water current falling outward at stirring blades 304 and by a second water current rising outward from first and second concave collecting basins 361 and 362, the washing articles are not driven into the center of pulsator 30 rather are unfolded above pulsator 30. Therefore, the operation of washing the washing articles is performed in such a way that the washing articles are not twisted. Also, stirring blades 301 and subsidiary stirring blades 302, disposed at the center of concave collecting basins 36, repeat forward and reverse rotation by means of the rotation of base plate 300. The rotation of stirring blades 301 and subsidiary stirring blades 302 cause the washing water to flow around in forward and reverse directions alternately, thereby generating a washing water current. At the same time, the first water current falling outward along curved portion 301*a* at stirring blades 301 is dashed against stirring blades 301 and subsidiary blades 302 thereby, to generating a lower water current. On the other hand, a second water current rising outward from the concave collecting basin 306 is also dashed against three stirring blades 301 and subsidiary stirring blades 302 thereby to generate a higher current than the first water current. Therefore, a current of the washing water is not uniform inside washing tub 200 thereby increasing washing efficiency.

Figure 5:
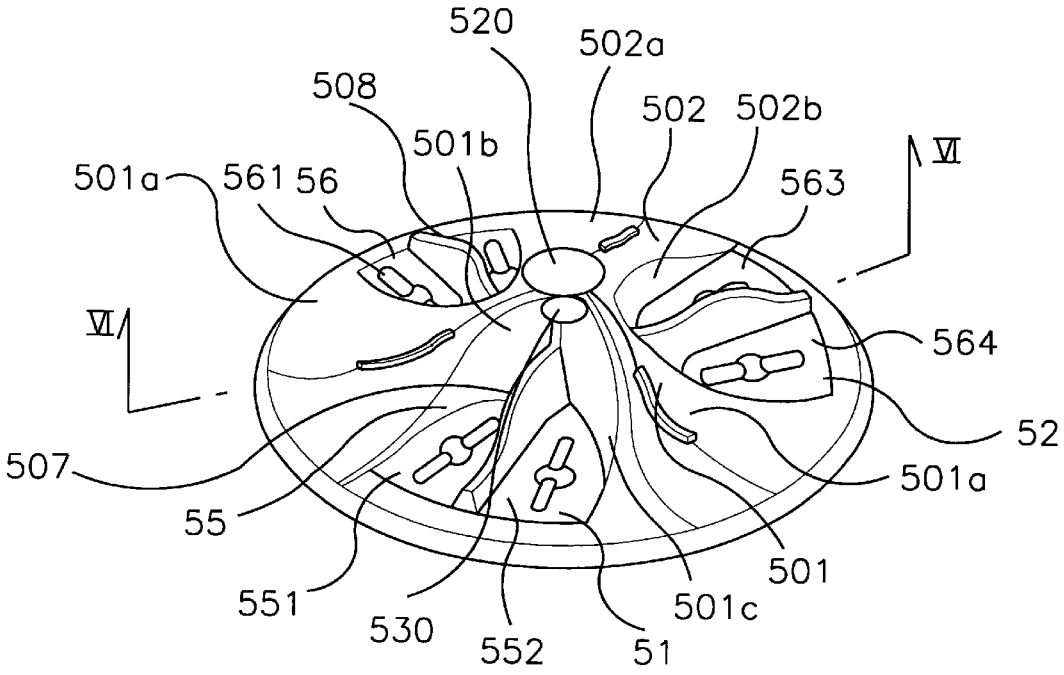
FIG. 5 is a perspective view for showing a configuration of a pulsator for a washing machine according to a second embodiment of the present invention.
Figure 6:
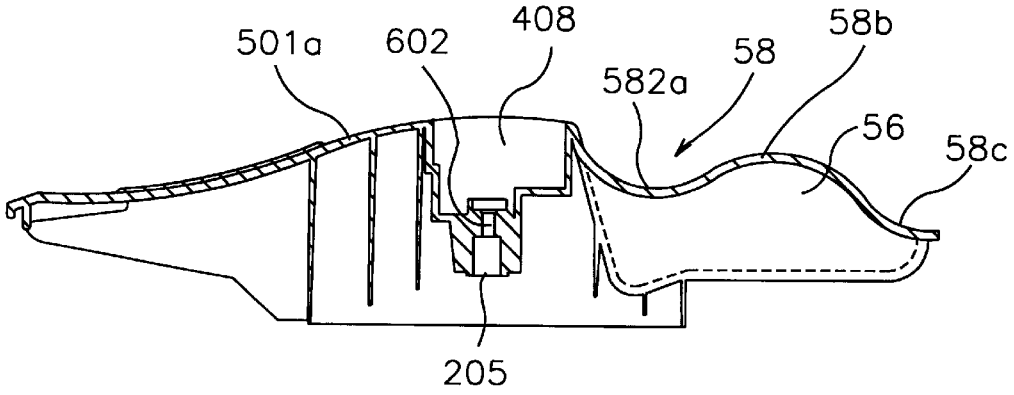
FIG. 6 is a sectional view of the pulsator taken along lines B—B of FIG. 5.

The pulsator for a washing machine according to the second embodiment of the present invention will be described below. FIGS. 5 and 6 show the pulsator for a washing machine according to the second embodiment of the present invention. As shown in FIG. 5, a pulsator 50 for a washing machine according to the second embodiment of the present invention includes a base plate 500, at least one first stirring blade 501, and at least one second stirring blade 502. Here, there are two first stirring blades 501 and one second stirring blade 502 shown. The pulsator 50 for a washing machine schematically has a bell shape in a perspective view. A center 530 of the two first stirring blade 501 and the one second stirring blade 502 is eccentrically positioned apart from the center 520 of base plate 300 by a predetermined distance.

Referring to FIGS. 2 and 6, a shaft connecting portion 608 is aligned at a center of base plate 500. Locking groove 602 is formed in the center axis of base plate 500. Base plate 500 is fixed to the shaft 205 of a shaft housing 204 through locking groove 602 and mounted in a washing tub 200. Base plate 500 includes a bottom surface 5 formed by first and second bottom surfaces 51 and 52 and is rotated according to a rotation of the shaft 205 to outwardly disperse washing water by a centrifugal force. Base plate 500 is a thin plate having a disc shape.

Two first stirring blades 501 are integrally and downwardly slanted from the center of base plate 500 to the outer periphery thereof in a sector form on an first bottom surface 51 of base plate 500, and define at least one first concave collecting basin 505 between adjacent stirring blades on an first bottom surface 51. Each of first stirring blade 501 includes a curved portion 501*a*, a first side wall 501*b*, and a second side wall 501*b*. The curved portion 501*a* is downwardly slanted from the center of base plate 300 to the outer periphery thereof in a sector form. Space between the first side wall 501*b* and the second side wall 501*c* on the first bottom surface 51 of base plate 500 forms a first concave collecting basin 55. The first concave collecting basin 55 has the first bottom surface 51 of the base plate 500 and the first and second side walls 501*b* and 501*c* of the first stirring blade 501. The first bottom surface 51, as viewed from the top, has a substantially elliptical cross section partially cut-away along with a line parallel to one of the axes of the ellipse. The first concave collecting basin 55 includes two concave collecting basins 551 and 552 having the same shape and size as each other, The washing water and the washing articles are dispersed outwardly and uniformly along curved portion 501*a* of first stirring blades 501.

One second stirring blade 502 is formed apart from the two first stirring blades 501 by a predetermined distance. The second stirring blade 502 has a size different from that of two first stirring blades 501, but the same shape. The second stirring blade 502 includes a curved portion 502*a*, a first aide wall 502*b*, and a second side wall 502*b*. The curved portion 502*a* is downwardly slanted from the center of base plate 500 to the outer periphery thereof in a sector form. The second stirring blade 502 defines two second concave collecting basins 506 between two second stirring blades 502. Space between the first side wall 502*b* and the second side wall 502*c* on the second bottom surface 52 of base plate 500 forms two second concave collecting basins 56. The two second concave collecting basins 56 have a size different from that of the first concave collecting basin 55 and the same shape as that thereof. In the second embodiment of the present invention, First stirring blade 501 is larger that second stirring blade 502, and first concave collecting basin 55 is wider than each of the two second concave collecting basin 56. The two second concave collecting basins 56 have four concave collecting basins 561, 562, 563, and 564 having the same shape and size as one another. First and second stirring blades 501 and 502 are rotated when base plate 500 is rotated from a predetermined waterflow in washing water thereby, generating a is predetermined waterflow in washing water in washing tub 200.

Pulsator 50 for a washing machine according to the second embodiment of the present invention further includes at least one first and second subsidiary stirring blades 507 and 508. There is one first subsidiary stirring blade 507 radially formed apart from two first stirring blades 501 by a predetermined distance between two first stirring blades 501 shown in FIG. 5. The one first subsidiary stirring blades 507 has a shape and size different from those of first and second stirring blades 501 and 502. Each of first subsidiary stirring blade 507 protrudes upwardly from a bottom portion of base plate 500 and includes first and second side walls 507*a* and 507*b* having a predetermined angle relative to the base plate 500. An upper portion 57 of the first subsidiary stirring blade

507 has a first concave portion 57*a*, a convex portion 57*b*, and a second concave portion 57*c*. Namely, the upper portion 57 of the first subsidiary stirring blades 507 protrudes at a radially middle portion thereof, and is downwardly sloped to either side of the middle portion.

Two second subsidiary stirring blades 508 are radially formed between the two first stirring blade 501 and the second stirring blade 502. The second subsidiary stirring blades 508 has a size different from that of the first subsidiary stirring blades 507, but the same shape. Preferably, in the second embodiment of the present invention, the first subsidiary stirring blades 507 are larger than the second subsidiary stirring blades 508. The second subsidiary stirring blade 508 protrudes upwardly from a bottom portion of base plate 500 and includes first and second side walls 508*a* and 508*b* having a predetermined angle relative to the base plate 500. An upper portion 58 of second subsidiary stirring blades 508 has a first concave portion 58*a*, a convex portion 58*b*, and a second concave portion 58*c*. Namely, the upper portion 58 of second subsidiary stirring blades 508 protrudes at a radially middle portion thereof, and is downwardly sloped to either side of the middle portion.

Operations of the pulsator for a washing machine according to the second embodiment of the present invention will be described below. For washing of washing articles, washing water fills washing tub 200. Upon operating the clutch (not shown), driving force of motor 202 is transmitted to pulsator 30, thereby causing pulsator 50 to be rotated forwardly and reversely. The rotation of pulsator 50 forms a predetermined waterflow in the washing water. At the same time, a first washing water located on two first stirring blades 501 is dispersed outward toward its lower portion along curved portion 501*a* slanted from the center of base plate 500 to the outer periphery thereof. A second washing water located on second stirring blades 502 is dispersed outward toward its lower portion along curved portion 502*a* slanted from the center of base plate 500 to the outer periphery thereof. A third washing water located on first concave collecting basin 55 is scattered outward toward an upper portion of base plate 500. A fourth washing water located on second concave collecting basin 56 is scattered outward toward an upper portion of base plate 500. Accordingly, the washing articles are not driven into the center of pulsator 50 thereby preventing washing articles being twisted.

A center 530 of first and second stirring blades 501 and 502, and first subsidiary stirring blades 507 and 508, is not formed with respect to a center 520 of base plate 500 as a starting point, and is located at an eccentrical position apart from the center 520 of base plate 50 by a predetermined distance, so that the washing articles are not driven into the center of pulsator 50 thereby preventing them from being twisted. Furthermore, since first stirring blade 501 is larger than second stirring blade 502, a stronger washing water current is generated around first stirring blade 501, and a weaker washing water current is generated around second stirring blade 502. Therefore, a great friction force of a washing water current is generated in washing tub 200 in a state that a current of the washing water therein is not uniform inside washing tub 200 thereby increasing washing efficiency.

As mentioned above, the pulsator for a washing machine according to the present invention, generates a vortex-type water current in a washing tub and evenly transmits a friction force generated by a washing water current to the washing articles in a state such that a current of the washing water is not uniform inside the washing tub thereby minimizing the twist of washing articles and increasing washing efficiency.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A pulsator for a washing machine, said pulsator comprising:

a base plate fixed to a shaft of the washing machine to be rotated according to a rotation of the shaft; and a plurality of stirring blades downwardly slanted from the center of said base plate to an outer periphery thereof in a sector form on an upper surface of said base plate and for defining at least one concave collecting basin between adjacent stirring blades on the upper surface of said base plate.

2. The pulsator for a washing machine as claimed in claim 1, wherein said pulsator has a bell shape.

3. The pulsator for a washing machine as claimed in claim 1, wherein said base plate has a disc shape.

4. The pulsator for a washing machine as claimed in claim 1, wherein three stirring blades are provided on the upper surface of said base plate, each being circumferentially 120° apart from adjacent stirring blades and having a same shape and size as one another.

5. The pulsator for a washing machine as claimed in claim 1, wherein each of two stirring blades includes a curved portion downwardly slanted from the center of said base plate to the outer periphery thereof in a sector form.

6. The pulsator for a washing machine as claimed in claim 1, wherein a center of said plurality of stirring blades is disposed at an eccentric position apart from the center of said base plate by a predetermined distance.

7. The pulsator for a washing machine as claimed in claim 1, wherein sines of said plurality of stirring blades are different from one another.

8. The pulsator for a washing machine as claimed in claim 1, further comprising a plurality of subsidiary stirring blades radially formed between said plurality of stirring blades, at least one of said plurality of subsidiary stirring blades having a size different from that of said plurality of stirring blades.

9. The pulsator for a washing machine as claimed in claim 8, wherein three subsidiary stirring blades are arranged between said plurality of stirring blades, each being circumferentially 120° apart from adjacent subsidiary stirring blades and having a same shape and size as one another.

10. The pulsator for a washing machine as claimed in claim 8, wherein said plurality of subsidiary stirring blades protrude upwardly from an upper portion of said base plate and includes first and second side walls having a predetermined angle relative to said base plate.

11. The pulsator for a washing machine as claimed in claim 8, wherein said plurality of subsidiary stirring blades each includes an upper portion protruding at a radially middle portion thereof, and being downwardly sloped at either side of a middle portion thereof.

12. The pulsator for a washing machine as claimed in claim 8, wherein sizes of said plurality of subsidiary stirring blades are different from each other.

13. The pulsator for a washing machine as claimed in claim 8, wherein a size of said plurality of stirring blades is larger than that of said plurality of subsidiary stirring blades.

14. A pulsator for a washing machine, said pulsator comprising:

a base plate fixed to a shaft of the washing machine to be rotated according to a rotation of the shaft;

a plurality of stirring blades downwardly slanted from the center of said base plate to an outer periphery thereof in a sector form on an upper surface of said base plate and for defining at least one concave collecting basin between adjacent stirring blades on the upper surface of said base plate; and at least one subsidiary stirring blade radially formed between said plurality of stirring blades, said at least one subsidiary stirring blade having a size different from that of said plurality of stirring blades.

15. A pulsator for a washing machine, said pulsator comprising:

a base plate fixed to a shaft of the washing machine to be rotated according to a rotation of the shaft;

a plurality of first stirring blades downwardly slanted from the center of said base plate to the outer periphery thereof in a sector form on an upper surface of said base plate and for defining at least one first concave collecting basin between first adjacent stirring blades on the upper surface of said base plate; and a plurality of second stirring blades formed apart from said plurality of first stirring blades by a predetermined distance and for defining at least one second concave collecting basin between second adjacent stirring blades and between said plurality of first stirring blades on the upper surface of said base plate, said plurality of second stirring blades each having a size different from that of said plurality of first stirring blades and the same shape as that thereof, a center of said plurality of first stirring blades and said plurality of second stirring blades is disposed at an eccentric position apart from the center of said base plate by a predetermined distance.

16. The pulsator for a washing machine as claimed in claim 15, wherein sizes of said plurality of first stirring blades are larger than those of said plurality of second stirring blades.

17. The pulsator for a washing machine as claimed in claim 15, wherein two first stirring blades are downwardly slanted from the center of said base plate to the outer periphery thereof in a sector form on the bottom surface of said base plate.

18. The pulsator for a washing machine as claimed in claim 15, further comprising at least one subsidiary stirring blade having a shape and a size different from those of said first and second stirring blades between said plurality of first stirring blades, between said plurality of second stirring blades, and between one of said plurality of first stirring blades and one of said plurality of second stirring blades.

19. A pulsator for a washing machine, said pulsator comprising:

a base plate fixed to a shaft of the washing machine to be rotated according to a rotation of the shaft;

a plurality of first stirring blades downwardly slanted from the center of said base plate to the outer periphery thereof in a sector form on an upper surface of said base plate and for defining at least one first concave collecting basin between first adjacent stirring blades on the upper surface of said base plate;

a plurality of second stirring blades formed apart from said plurality of first stirring blades by a predetermined distance and for defining at least one second concave collecting basin between second adjacent stirring blades and between said plurality of first stirring blades on the upper surface of said base plate, said plurality of second stirring blades each having a size different from that of said plurality of first stirring blades and the same shape as that thereof; and at least one subsidiary stirring blade having a shape and a size different from those of said first and second stirring blades between said plurality of first stirring blades, between said plurality of second stirring blades, and between one of said plurality of first stirring blades and one of said plurality of second stirring blades, a center of said plurality of first stirring blades, said plurality of second stirring blades and said at least one subsidiary stirring blade is disposed at an eccentric position apart from the center of said base plate by a predetermined distance.

* * * * *